US008579651B2

(12) United States Patent
Hanning et al.

(10) Patent No.: US 8,579,651 B2
(45) Date of Patent: Nov. 12, 2013

(54) CONNECTION DEVICE FOR CONDUCTORS

(75) Inventors: Walter Hanning, Detmold (DE); Stephan Fehling, Lage (DE); Herbert Fricke, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 51 days.

(21) Appl. No.: 13/382,921

(22) PCT Filed: Jul. 12, 2010

(86) PCT No.: PCT/EP2010/059982

§ 371 (c)(1),
(2), (4) Date: Jan. 7, 2012

(87) PCT Pub. No.: WO2011/009749

PCT Pub. Date: Jan. 27, 2011

(65) Prior Publication Data

US 2012/0108099 A1 May 3, 2012

(30) Foreign Application Priority Data

Jul. 18, 2009 (DE) ..... 20 2009 009 831 U
Jul. 9, 2010 (DE) ..... 20 2010 008 028 U

(51) Int. Cl.
*H01R 4/24* (2006.01)

(52) U.S. Cl.
USPC ..... 439/441

(58) Field of Classification Search
USPC ..... 439/441, 438
See application file for complete search history.

(56) References Cited

U.S. PATENT DOCUMENTS 5,409,407 A * 4/1995 Mizuno et al. ..... 439/860
6,336,824 B1 * 1/2002 Sorig ..... 439/441
6,682,364 B2 * 1/2004 Cisey ..... 439/441
6,712,641 B2 * 3/2004 Beege et al. ..... 439/441
6,851,967 B2 * 2/2005 Miyoshi et al. ..... 439/441
7,004,781 B2 * 2/2006 Walter ..... 439/441
7,993,156 B2 * 8/2011 Holste ..... 439/441
8,251,738 B2 * 8/2012 Heckert et al. ..... 439/441
2004/0248457 A1 * 12/2004 Walter ..... 439/441
2006/0063419 A1 * 3/2006 Steinkemper et al. ..... 439/441
2007/0099479 A1 * 5/2007 Holterhoff et al. ..... 439/441

FOREIGN PATENT DOCUMENTS

DE 3019149 A1 11/1981
DE 20117770 U1 10/2002
DE 102 53 858 A1 6/2004
DE 10 2004 059 017 A1 6/2006
DE 20 2006 009 460 U1 4/2007
WO 20061106201 A1 10/2006

* cited by examiner

*Primary Examiner* — Gary Paumen
(74) *Attorney, Agent, or Firm* — Lawrence E. Laubscher, Sr.; Lawrene E. Laubscher, Jr.

(57) ABSTRACT

An electrical connector includes a U-shaped metal clamping frame having vertical base and side walls defining a chamber, a stationary electrical contact mounted in the chamber, and a clamping spring arrangement arranged at least partially within the chamber for biasing toward the electrical contact the bare end of an insulated conductor that is axially inserted downwardly into the chamber. The clamping spring comprises a conductive leaf spring having a clamping leg that is inclined, when in the conductor clamping position, at a first acute angle relative to the insertion axis of the conductor. In one embodiment, the clamping leg is supported by an attachment arrangement including an attachment leg arranged at second acute angle relative to the insertion axis. In another embodiment, the clamping leg is integrally connected with the clamping frame, and with the frame base wall defining the stationary electrical contact.

16 Claims, 17 Drawing Sheets

CONNECTION DEVICE FOR CONDUCTORS

REFERENCE TO RELATED APPLICATIONS

This application is a national stage application under 35 U.S.C. §371 of International Application No. PCT/EP2010/059,982 filed Jul. 12, 2010, based on the German priority applications Nos. DE 20 2009 009 831.1 filed Jul. 18, 2009, and DE 20 2010 008 028.2 filed Jul. 9, 2010.

BACKGROUND OF THE INVENTION

1. Field of the Invention

An electrical connector includes a U-shaped metal clamping frame having vertical base and side walls defining a chamber, a stationary electrical contact mounted in the chamber, and a clamping spring arrangement arranged at least partially within the chamber for biasing toward the electrical contact the bare end of an insulated conductor that is axially inserted downwardly into the chamber. The clamping spring comprises a conductive leaf spring having a clamping leg that is inclined, when in the conductor clamping position, at a first acute angle relative to the insertion axis of the conductor.

2. Description of Related Art

It is well known in the patented prior art to provide electrical connectors having resilient clamping means for biasing the bare end of an insulated conductor toward engagement with a stationary contact contained within the connector housing. Such connection apparatuses are known in a large variety of configurations. For a few years special emphasis has been placed again on connection apparatuses which have already been known for a long time and which allow tool-free insertion. Reference is hereby made by way of example in this connection to DE 30 19 149 C2, DE 201 17 770 U1 and DE 20 2006 009 460 U1. These specifications respectively show screwless terminals with a clamping spring (pressure spring) which is used for tightly clamping a conductor at a clamping point between a free leg of the pressure spring and a conductor rail. This type of contact will be referred to below as "direct insertion technology". It is also known to assign a pressing element to the connection apparatus, with which the clamping point in the contact state can be released again.

Although the solutions of the state of the art have proven their worth, there is still a need for a connection apparatus for conductors in the described "direct insertion technology" which has a very narrow overall width relative to the conductor.

SUMMARY OF THE INVENTION

Accordingly, a primary object of the present invention is to provide an electrical connector including a U-shaped metal clamping frame having vertical base and side walls defining a chamber, a stationary electrical contact mounted in the chamber, and a clamping spring arrangement arranged at least partially within the chamber for biasing toward the electrical contact the bare end of an insulated conductor that is axially inserted downwardly into the chamber, said clamping spring comprising a conductive leaf spring having a clamping leg that is inclined, when in the conductor clamping position, at a first acute angle relative to the insertion axis of the conductor.

According to another object, in a preferred embodiment, the clamping leg is supported in the frame chamber by an attachment arrangement including an attachment leg arranged at second acute angle relative to the insertion axis, thereby to apply a strong biasing force on the clamping leg. In another embodiment, the clamping leg is integrally connected with the clamping frame.

The U-shaped profile of the clamping frame preferably consists of a very thin spring steel sheet and encloses the clamping spring as a unit. The overall width can be kept at a very low level as a result of the thin walls of the clamping frame which consists of spring steel sheet. The clamping spring is guided and protected well by the side walls or legs of the U-profile.

When the clamping spring is tensioned by connection with the conductor, the forces in the clamping frame are absorbed as a result of the configuration of the clamping spring arrangement in such a way that no additional force component will arise which will twist the clamping spring. The clamping spring therefore advantageously does not exert any opening force component on the clamping frame. The U-profile substantially only absorbs tensile and pressure forces.

It is also possible to produce the clamping spring and the clamping frame in an integral manner from a sheet-metal blank. In this case, a material will be used which has favorable resilient and good electrically conductive properties.

BRIEF DESCRIPTION OF THE DRAWINGS

Other objects and advantages of the invention will become apparent from a study of the following specification, when viewed in the light of the accompanying drawing, in which:

FIG. 10*b* is a sectional view taken through the connector with the conductor fully inserted therein, and FIG. 8*c* is a perspective view of the connector with the conductor inserted therein;

DETAILED DESCRIPTION OF THE INVENTION

Figure 1A:
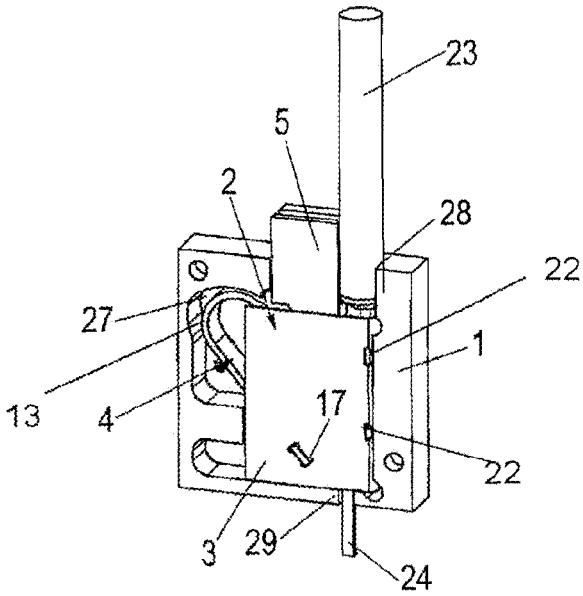
FIGS. 1 and 1*b* are perspective views, respectively, of a connector apparatus inserted in an insulating material housing, and a sectional view through the arrangement of FIG. 1*a;*
Figure 1B:
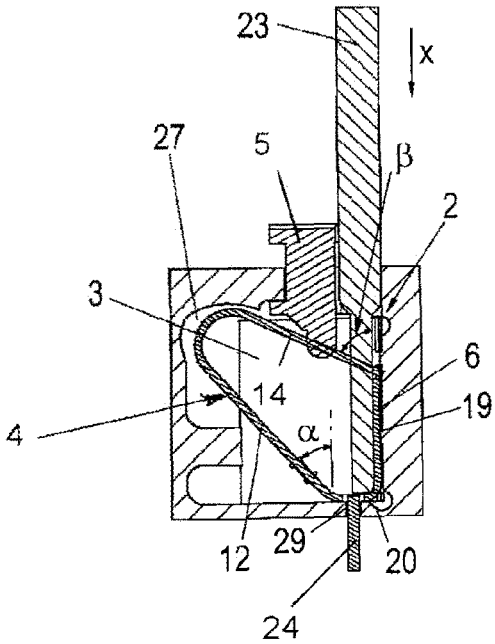

Referring first more particularly to FIGS. 1*a*-1*c*, the connector 2 includes a clamping frame 3 which is preferably not circumferentially enclosed, a clamping leaf spring 4 which acts as a pressure spring, and an actuating button 5 for opening the clamping leg of the clamping spring, especially for disconnection. In accordance with FIG. 1, the clamping spring 4 also acts as an element which is configured to conduct electrical current.

Figure 2B:
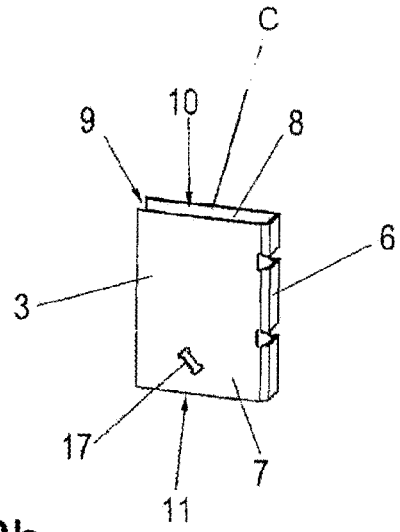
FIG. 2*b* is a perspective view of a clamping frame of the connector apparatus of FIG. 1.

The clamping frame 3 a U-shaped horizontal profile (also see FIG. 2*b*), comprising a vertical base leg or wall 6, and two parallel spaded side legs or walls 7, 8 which extend in spaced relation at a right angle to the base leg 6 and parallel with respect to one another. The longitudinal legs or side walls 7, 8 are longer than the base leg 6, preferably they are twice as long and more preferably three times as long as the base leg 6.

The U-shaped clamping frame 3 is arranged to be open on three sides. One open side is the side 9 extending opposite of the base leg 6; the other two open sides are the insertion side 10 and the base side 11 opposite of the insertion side.

The clamping frame 3 preferably consists of spring steel sheet. This spring steel sheet can be provided with a very thin configuration, which allows providing the entire connection apparatus with an especially narrow configuration perpendicular to the plane of projection of FIG. 1*b*. Preferably, the spring steel sheet has a thickness of less than 0.5 mm and more preferably a thickness of less than 0.3 mm. Suitable materials for producing the spring steel sheet are spring steel or other spring materials which optionally can also be arranged to offer good electrical conductivity.

Figure 2A:
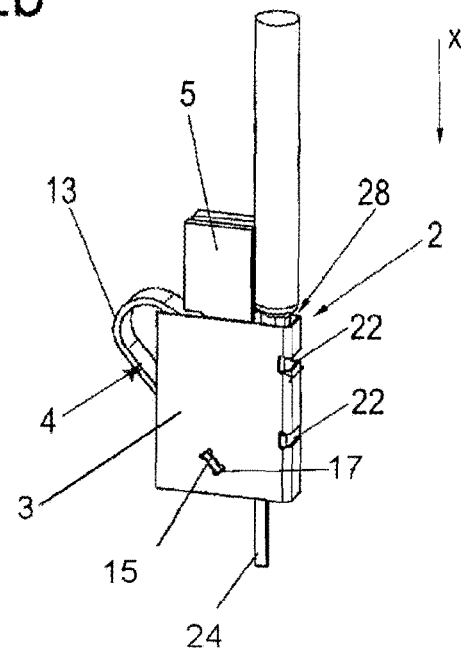
FIG. 2*a* is a perspective view of the connector apparatus of FIG. 1.
Figure 2C:
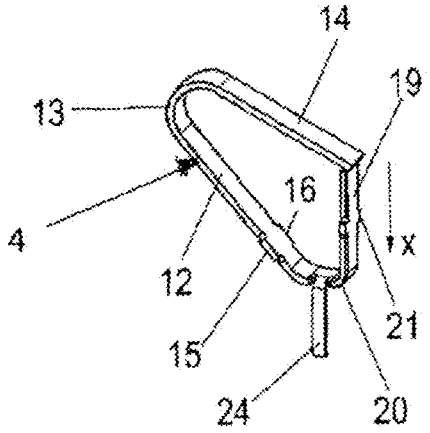
FIG. 2*c* is a perspective view of a clamping spring of the connector apparatus of FIG. 1.
Figure 3:
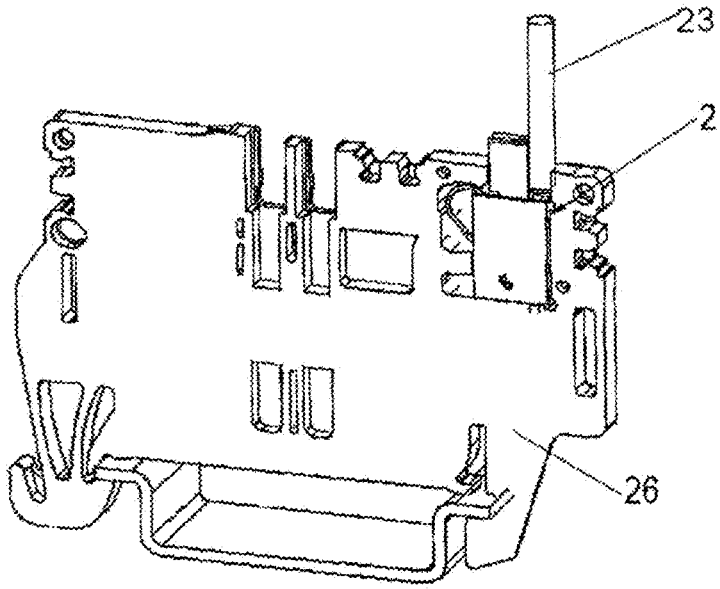
FIG. 3 is a perspective view of a connector apparatus inserted into an insulating material housing arranged as a terminal block housing.

The clamping spring 4 is inserted into the chamber C of the clamping frame 3. The clamping spring 4 (see FIGS. 1*b* and 2*c*) comprises at least one attachment leg 12 with which it is fixed to the clamping frame 3, and a contact clamping leg 14 which is connected with the attachment leg 12 via a resilient bend portion 13.

The insertion direction of the conductor parallel to the base leg 6 will be designated below with the designation X. The attachment leg 12 extends at an angle $\alpha$ to the conductor insertion direction X and to the base leg 6 of the clamping frame 3. Preferably, the attachment leg 12 angle $\alpha$ lies between 20° and 70°, preferably between 30° and 60°. As a result, the attachment leg 12 is normally arranged obliquely at an acute angle in relation to the conductor insertion direction X.

The attachment of the attachment leg 12 on the clamping frame 3 preferably occurs in such a way that the attachment leg comprises lateral protrusions 15, 16 (see FIG. 2*c* again) which engage into corresponding openings 17 (FIG. 2*b*) in the two mutually parallel longitudinal legs 7, 8. Such engagement preferably occurs in a latching manner.

The attachment leg 12 extends in the connector from the openings 17 laterally through the open side 9 disposed to face away from the base leg 6 out of the interior of the clamping frame 3, so that the bend 13 is disposed here outside of the clamping frame 3. The bend is arranged in such a way that the clamping leg 14 is disposed obliquely in relation to the conductor push-in direction X. Preferably, the angle $\beta$ between the conductor insertion direction X and the clamping leg 14 is between 60° and 80°.

The clamping leg 14 is preferably so long that in the state in which no contact is made with conductor 23 a slight pretension is applied to the inside of the base leg 6 or an electrically conductive abutment element disposed on its inside. The location of the attachment of the attachment leg 12 in the clamping frame 3, which in this case is in the two longitudinal legs 7, 8, and the length of the attachment leg 12 up to the bend also have an influence on the configuration of the resilient system.

When a conductor 23 is axially inserted into the clamping frame 3 in the insertion direction X, it slides the clamping leg 14 downwardly and also to the side, with the clamping leg 14 in the connected state biasing the bare end 23*a* of the conductor 23 against an electrically conductively arranged abutment element which carries out a conductor rail function. In the illustrated embodiment, this abutment element comprises in a preferable (but not mandatory) configuration a contact leg 19 which is connected via a further bend 20 with the attachment leg 12 on its side facing away from the bend 13. According to FIG. 1*b*, the contact leg 19 rests on the inside of the frame base wall 6. It can also be fixed to the same by means of one or several lateral protrusions 21 in corresponding openings 22 in the clamping frame 3, which preferably again occurs in a latching manner. Two of the openings 22 are shown by way of example in FIG. 2*a*, although the contact leg 19 comprises only one such protrusion.

FIG. 1*a* shows the connector 2 in the contacted state. FIG. 1*b* shows the connection apparatus 2 in the non-contacted state, with the drawing of conductor 23 indicating how the conductor 23 would be disposed in the fully inserted position in the clamping frame 3. The clamping leg 14 biases the conductor 23 against the contact leg 19 in this case. The clamping leg 14 presses the conductor 23 in the contacted state against the abutment element, according to FIG. 1*b* therefore against the contact leg 19. As a result, only two parts are required for realizing the connection apparatus 2 in direct push-in technology.

Alternatively, the clamping frame 3 per se could also consist of a resilient and electrically conductive material, thereby forming the conductive abutment element itself. This configuration would especially save material (see FIGS. 5, 6, and 11).

Figure 10A:
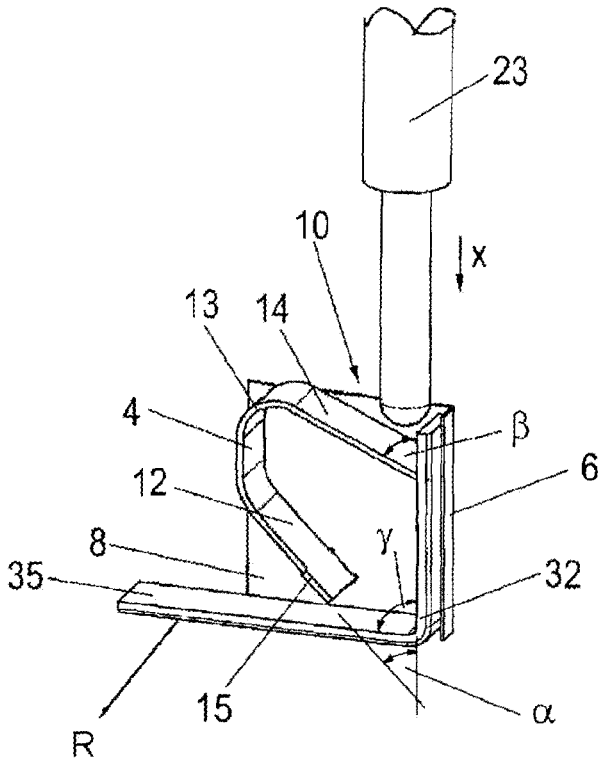
FIGS. 10*a* to 10*c* are views of a further embodiment of a connector with a conductor, with FIG. 10*a* being a sectional view taken through the connector with conductor being inserted therein.
Figure 10B:
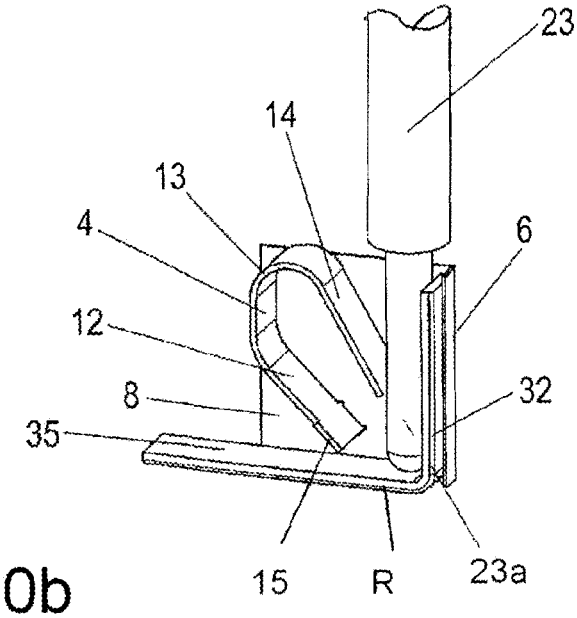
Figure 10C:
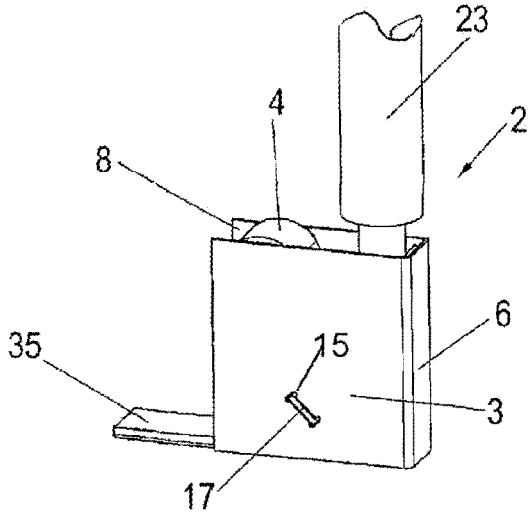

Instead of a contact leg 19, it would also be possible to use a conductor rail 32 arranged separately from the clamping spring 4 as a conductive abutment element (see FIGS. 8 and 10).

Figure 4:
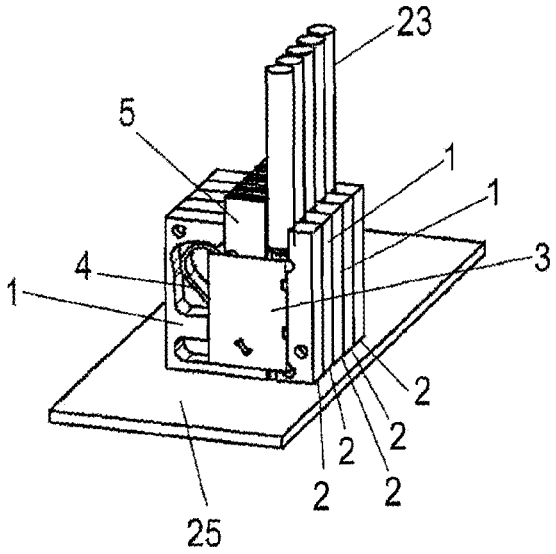
FIG. 4 is a perspective view of a succession of connector of the type of FIG. 1 mounted on a printed circuit board.
Figure 5C:
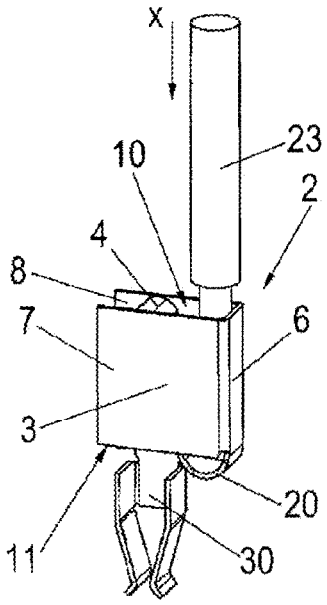
FIGS. 5*a* to 5*d* are perspective views of a further embodiment of a connector with and without an inserted conductor, with FIG. 5*a* showing the connection apparatus without inserted conductor, FIG. 5*b* showing a sectional view through FIG. 5*a*, FIG. 5*c* the connection apparatus with inserted conductor, and FIG. 5*d* a sectional view through FIG. 5*c;*
Figure 5A:
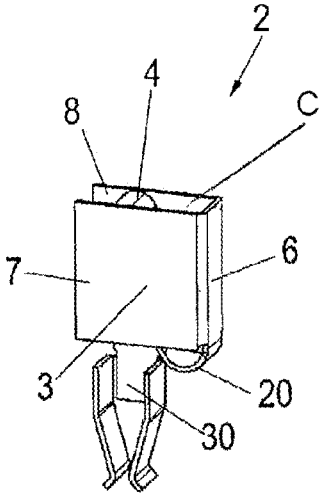
Figure 5B:
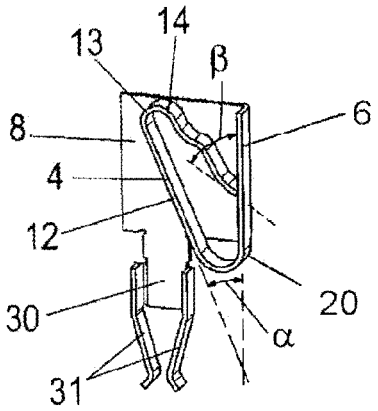
Figure 5D:
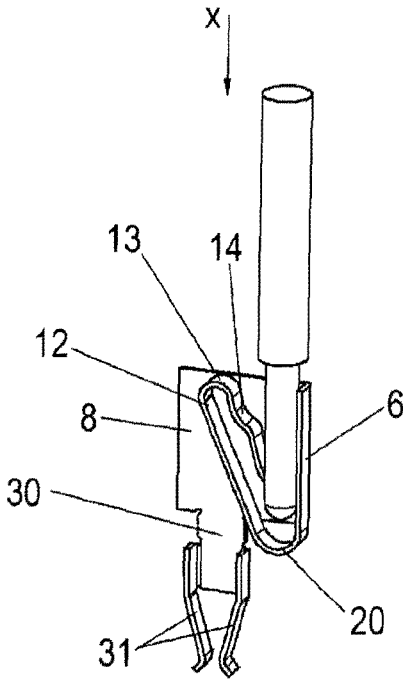

A soldering pin 24 is arranged on the clamping spring 4 by way of example according to FIG. 1, which soldering pin extends outwardly from the base side 11 of the clamping frame 3, so that the connection apparatus 2 can be soldered easily onto a circuit board 25 (see FIG. 4).

Alternatively, it could also comprise a soldering pad or a conductor rail or the like, e.g. in order to install it in a terminal block 26; see FIGS. 3, 7*b*, 9*b*, 12*b*, which illustrate in a purely exemplary manner the installation of the connection apparatus 2 into a respective removed portion 27 in an insulating material housing 1, with elements such as a conductor rail not being shown in the insulating material housing 1 for reasons of simplicity of the illustration.

In accordance with FIG. 1, the connection apparatus 2 is inserted into the insulating material housing 1, which comprises a housing chamber 27 for accommodating the connection apparatus 2 and which is arranged in such a way that it accommodates the clamping frame 3 and the bend 13 of the clamping spring 4. The insulating material housing 26 further comprises an insertion opening 28 for inserting the conductor 23 and the aforementioned actuation button 5 which is disposed in a laterally offset manner in relation to the insertion opening 28 and which enables the opening of the clamping point especially for disconnecting and optionally also for connecting.

It is also possible to not provide an actuation button 5 and to directly open the clamping point optionally with a tool such as a screwdriver. The insulating material housing 1 further comprises an opening 29 in accordance with FIG. 1, by means of which the soldering pin 24 extends outwardly from the insulating material housing.

The module consisting of clamping spring 4 and the clamping frame 3 can be inserted in a large variety of housings.

FIG. 5 shows an embodiment of a connection apparatus 2 in accordance with the invention, in which the clamping spring 4 is integrally arranged with the clamping frame 3 in contrast to the embodiment according to FIG. 1. FIGS. 5*c*, 5*d* show the connector apparatus 2 in the state of contact.

The clamping spring 4 comprises an attachment leg 12 and a clamping leg 14, which are connected with one another via an integral bend portion 13. The bend portion 13 is also arranged in this embodiment in such a way that the clamping leg 14 is arranged obliquely to the conductor insertion direction X. The attachment leg 14 is further fixed to the base leg 6 via a second bend portion 20, with the attachment leg 12 also having an angle $\alpha$ with the base leg 6 and the conductor push-in direction X, so that it is aligned obliquely in relation to the conductor insertion direction X.

The clamping spring 4 is arranged between the longitudinal side walls or legs 7, 8 of the clamping frame 3, and the bend portion 13 between the attachment leg 14 and the clamping leg 12 is provided in such a way that the base leg 6 of the clamping frame 3 acts as an abutment element for a conductor 23 inserted into the connection apparatus 2. In contrast to the embodiment of FIG. 1, no additional contact leg 19 (see FIG. 1) has been provided as an abutment element between the base leg 6 and the clamping leg 14.

In the embodiment as illustrated here, a contact tulip 30 is further integrally formed on one of the longitudinal legs 7, 8 of the clamping frame 3. The contact tulip 30 comprises two oppositely disposed tulip legs 31 which are bent towards one another. In this embodiment, the clamping frame therefore also assumes the function of current conduction.

Figure 6A:
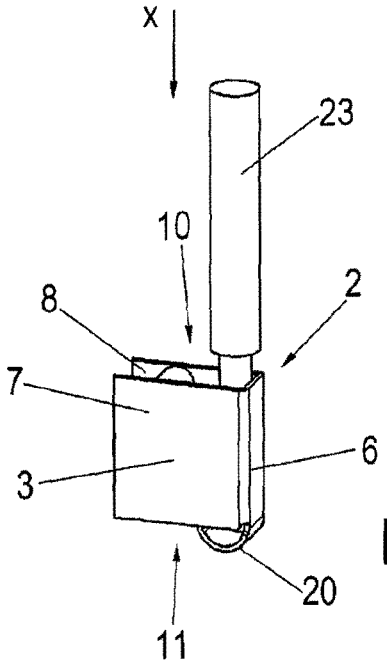
FIGS. 6*a* and 6*b* are perspective views of a further embodiment of a connect or with an inserted conductor, with FIG. 6*b* showing a sectional view through FIG. 6*a;*
Figure 6B:
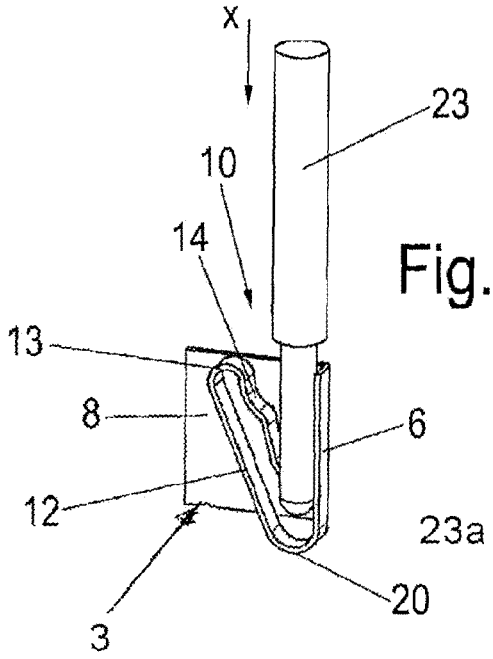
Figure 7A:
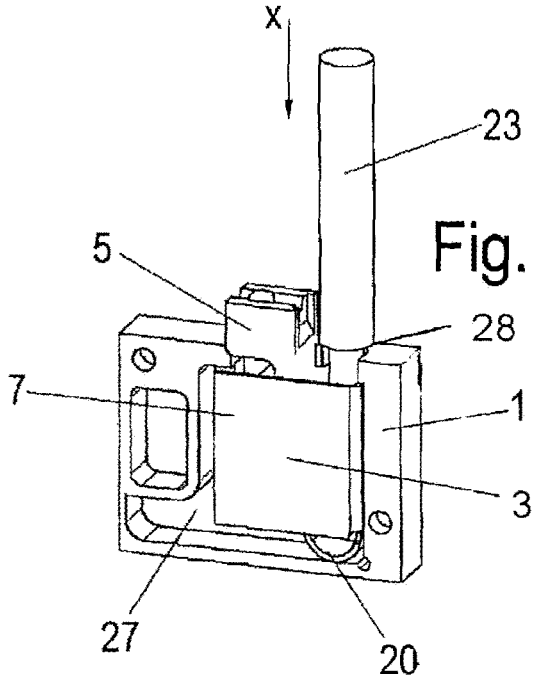
FIGS. 7*a* and 7*b* each show a perspective view of the connection apparatus of FIG. 6 inserted in an insulating material housing, with the insulating material housing of FIG. 7*b* being arranged as a terminal block housing.
Figure 7B:
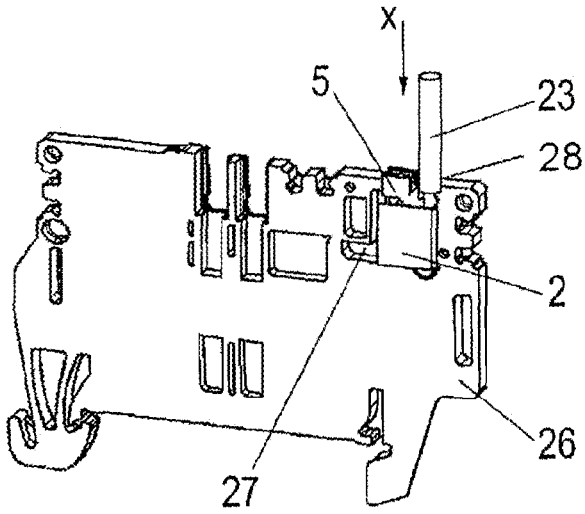

The embodiment of the connection apparatus 2 of FIG. 6 corresponds to the embodiment of FIG. 5 with the difference that it does not comprise any contact tulip 30. FIG. 7 shows the connection apparatus 2 of the embodiment of FIG. 6 in an insulating material housing 1. The insulating material housing of the embodiment of FIG. 7 comprises a chamber 7 for accommodating the connection apparatus. The chamber 27 is arranged in this case in such a way that it accommodates the clamping frame 3 and the bend 20 of the clamping spring 4 between the attachment leg 12 and the base leg of the clamping frame 3. Furthermore, this insulating material housing 26 also comprises an insertion opening 28 for inserting the conductor 23 and the actuation button 5. In this case too, the actuation button 5 is arranged laterally offset relative to the insertion opening 28. The insulating material housing 1 which is arranged in FIG. 7*b* as a terminal block housing 26 differs from the terminal block housing 26 of the embodiment of FIG. 4 especially by the shape of the removed portion 27 provided for the accommodation of the connection apparatus 2.

In contrast to the connector devices 2 illustrated up until now, the embodiment of the connection apparatus 2 in accordance with the invention as shown in FIG. 8 comprises a conductor rail R having a vertical leg portion 32 serving as an abutment element. That is why the clamping spring 4 also does not comprise any contact leg 19 (see FIG. 1*b*). This embodiment of FIG. 8 comes with the advantage that a material can be used for the conductor rail R which is of higher quality with respect to its conductive properties such as a material containing copper for example than for the clamping frame 3 which is preferably made as a punched part from a sheet metal and can therefore be produced at very low cost. Principally, an embodiment is also possible in which the conductor rail R is arranged integrally with the clamping frame 3. The clamping frame 3 therefore does not assume the conduction of the current in this embodiment; instead, this function is assumed by the conductor rail R.

The conductor rail vertical leg portion 32 comprises protrusions 33 on opposite sides, which protrusions respectively engage into openings 34 of the longitudinal side walls 7, 8 of the clamping frame 3, so that it is mounted between the longitudinal legs 7, 8 of the clamping frame 3 and in the openings 34.

Furthermore, the clamping spring 4 of the embodiment of FIG. 8 is arranged integrally with the clamping frame 3 in a manner analogous to the embodiments of FIGS. 5 and 6. In this case however the base leg 6 of the clamping frame 3 simultaneously forms the attachment leg 12 in contrast to the embodiments of FIGS. 5 and 6.

Figure 8A:
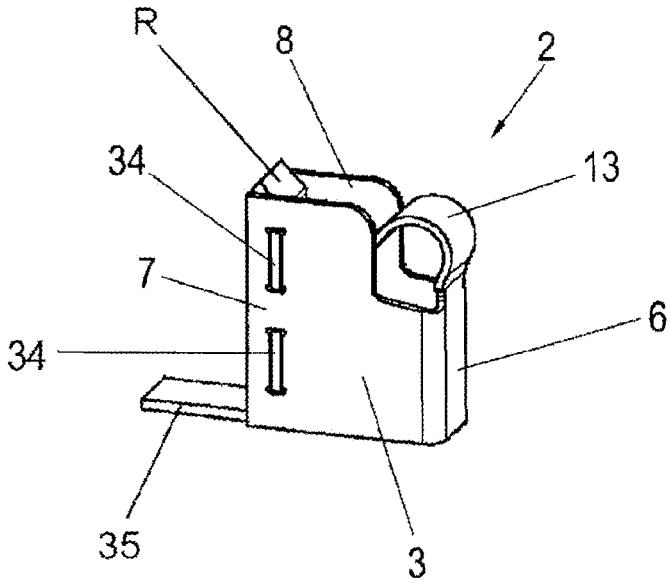
FIGS. 8*a* to 8*c* are views of a further embodiment of a connection apparatus with and without inserted conductor, with FIG. 8*a* showing the connection apparatus without inserted conductor, FIG. 8*b* being a sectional view through FIG. 8*a*, FIG. 8*c* illustrating the conductor being inserted into the connector, FIG. 8*d* the connector with inserted conductor, and FIG. 8*e* a sectional view taken through FIG. 8*d;*
Figure 8B:
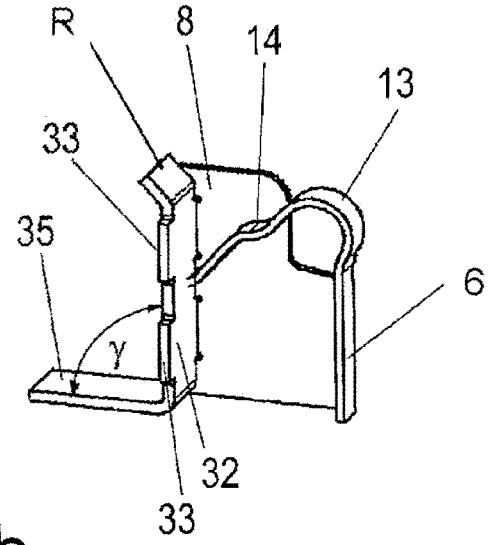
Figure 8C:
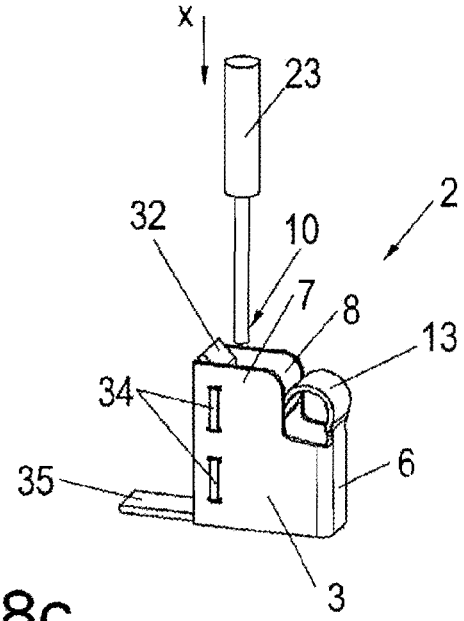
Figure 8D:
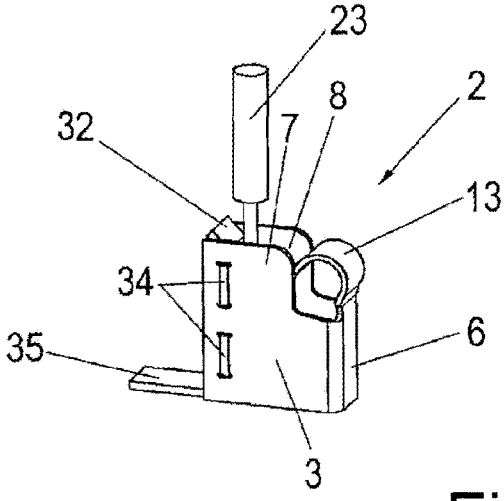
Figure 8E:
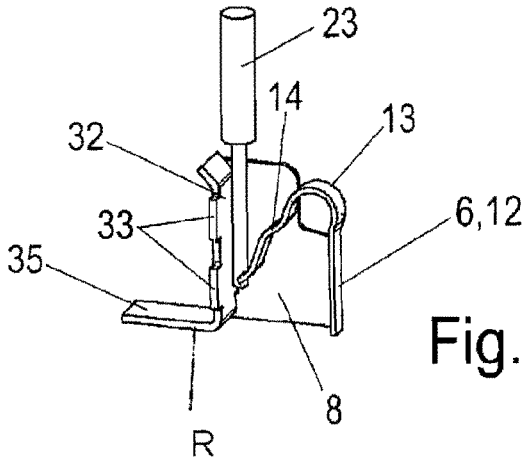

Since the conductor rail vertical portion 32 is arranged in this case parallel with and spaced from the frame base wall 6, base wall 6 (serving as the attachment leg 12) is also parallel in contrast to the embodiments of the connector apparatus 2 as illustrated above and is not arranged obliquely in relation to the conductor push-in direction X. When inserting the conductor 23 in the conductor push-in direction X, it is arranged between the conductor rail 32 and the clamping leg 14 and pressed by means of the clamping leg 14 against the conductor rail 32, so that it makes secure contact with the conductor rail 32. FIG. 8*d* shows the conductor 23 in the state when inserted into the connection apparatus 2 and when making contact.

The conductor rail R includes a contact tongue portion 35 for the connection of an electric module (not shown) such as a further conductor, which contact tongue is bent outwardly at an angle $\gamma$ (at a right angle in this case), so that it protrudes at least partly out of the clamping frame 3.

Figure 9A:
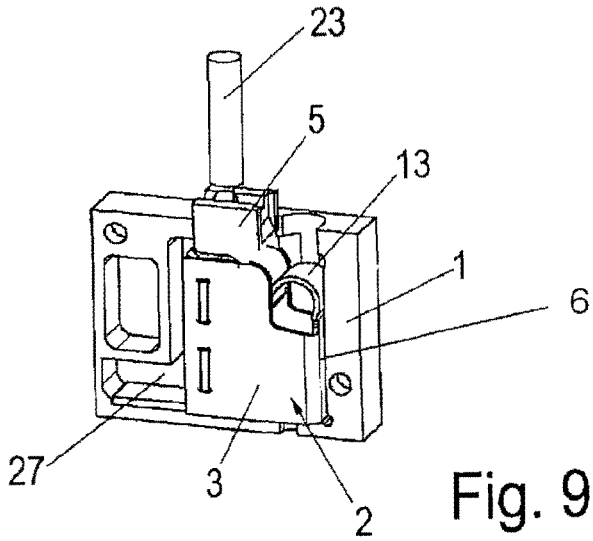
FIGS. 9*a* and 9*b* are, respectively, a perspective view of the connector of FIG. 8 inserted into an insulating material housing, with the insulating material housing of FIG. 9*b* being arranged as a terminal block housing.
Figure 9B:
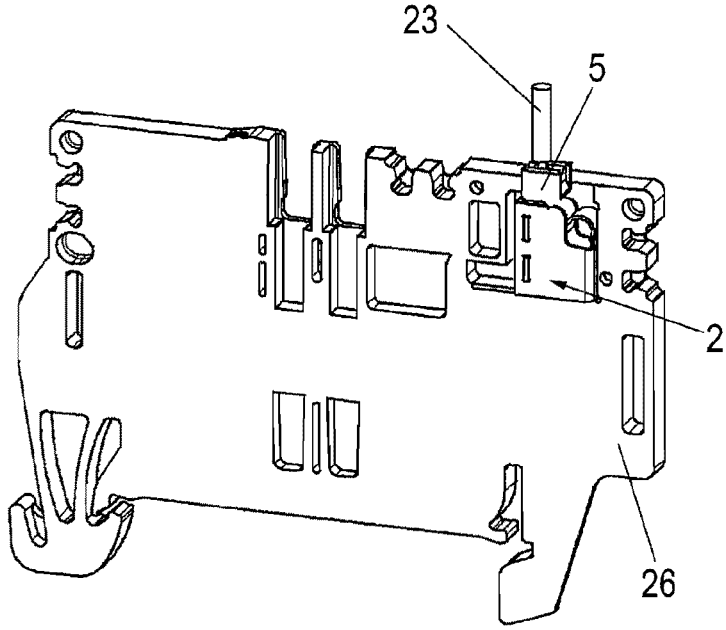

In FIGS. 9*a*, 9*b*, the connect 2 of the embodiment of FIG. 8 is respectively arranged in an insulating material housing 1. In this case too, the chamber removed portion 27 is respectively provided in such a way that it accommodates the clamping frame 3 and the bend 13 between the base leg 6 of the clamping frame 3 and the clamping leg 14 of the clamping spring 4. Moreover, the removed portion 27 also accommodates the contact leg 35 of the conductor rail 32.

The optional actuation button 5 is respectively further provided in the FIGS. 9*a*, 9*b*. In this embodiment of the connector 2 of FIG. 9 and in contrast to the aforementioned embodiments, the conductor 23 inserted into the connector 2 is guided through the actuation button 5.

FIG. 10 shows an embodiment of a connection apparatus 2 in accordance with the invention, which comprises a separately produced conductor rail 32 and a separately produced clamping spring 4 in addition to the clamping frame 3. This embodiment comes with the advantage that the materials from which the respective components 3, 4, 32 are made can be chosen optimally according to their respective function. That is why a well-conducting material can be chosen for the conductor rail 32, a material with favorable spring properties can be used for the clamping spring 4, and an inexpensive but stable material can be used for the clamping frame 3.

The conductor rail vertical portion 32 extends at least partly parallel to the base leg 6 of the clamping frame 3 and acts as an abutment element for clamping the conductor 23 between the clamping leg 14 of the clamping spring 4 and the conductor rail portion 32. The vertical rail portion 32 is preferably provided with lateral protrusion corresponding with the connecting protrusions 33 of FIG. 8*b*. Moreover, this conductor rail 32 also comprises a contact tongue 35 in analogy to the conductor rail of the embodiment of FIG. 8, which contact tongue protrudes at least partly out of the clamping frame 3. For this purpose, the conductor rail 32 is bent in this embodiment of FIG. 10*a* at an angle γ, which in this case is a right angle.

Analogous to the embodiment of FIG. 1, the clamping spring 4 of FIG. 10 respectively comprises a protrusion 15, 16 on opposite sides of its attachment leg 12, which protrusion engages in an opening 17 of one of the longitudinal legs 7, 8 of the clamping frame 3. As a result, the clamping spring 4 is fixed between the longitudinal legs 7, 8. Moreover, it comprises the clamping leg 14 which presses the inserted conductor 23 against the conductor rail 32. A bend 13 is also provided between the attachment leg 12 and the clamping leg 14. Furthermore, the clamping leg 14 of FIG. 10 is arranged at an angle β and the attachment leg 12 of FIG. 10 at an angle α in relation to the conductor push-in direction X.

The clamping spring 4 of the embodiment of FIG. 10 is arranged virtually completely within the clamping frame 3 however and it extends in part between the attachment leg 12 and the clamping leg 14 approximately parallel to the conductor insertion direction X.

Figure 11A:
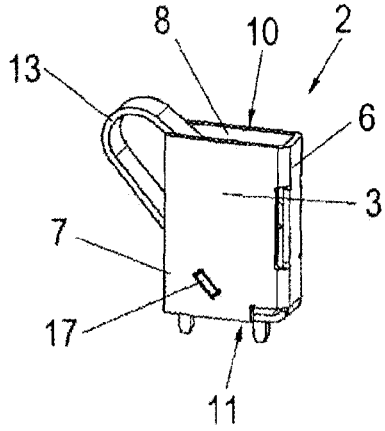
FIGS. 11*a* to 11*c* are views of a further embodiment of a connectors with and without inserted conductor, with FIG. 11*a* showing the connection apparatus without inserted conductor, FIG. 11*b* being a sectional view through FIG. 11*a*, and FIG. 11*c* illustrating the connection apparatus with inserted conductor.
Figure 11B:
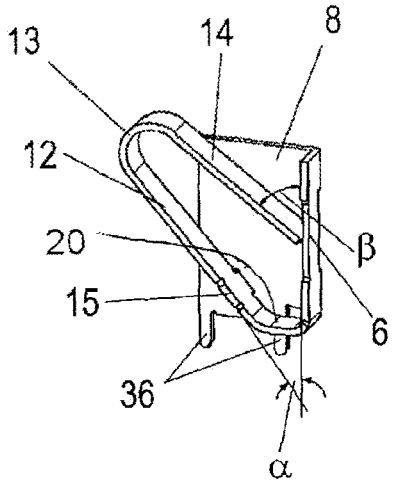
Figure 11C:
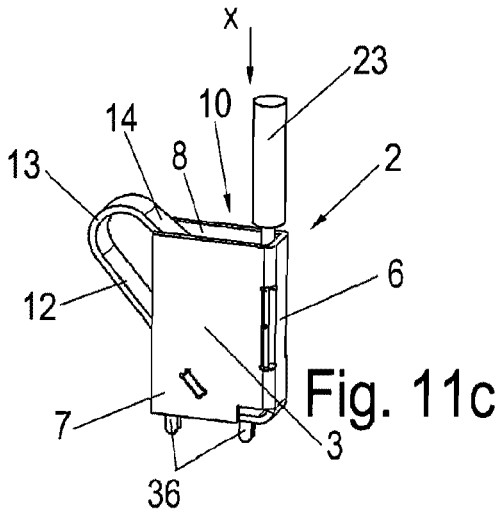

Analogous to the embodiment of FIG. 6, the clamping spring 4 is formed integrally with the clamping frame 3 in the connection apparatus 2 in accordance with the invention of the embodiment of FIG. 11. The clamping spring 4 also comprises the clamping leg 14, the attachment leg 12 and the bend 13 between the clamping leg 14 and the attachment leg 12, with both the clamping leg 14 being arranged at an angle β and also the attachment leg 12 at an angle α in relation to the conductor push-in direction X. A bend 20 is further also provided between the base leg 6 of the clamping frame 3 and the attachment leg 12 of the clamping spring 4, on which the clamping spring 4 is integrally fixed to the base leg 6.

The embodiments differ however in the shape of the clamping spring 4. However, the bend 20 of the embodiment of FIG. 6 which is arranged between the base leg 6 and the attachment leg 12 protrudes out of the clamping frame 3, and the bend 13 of the embodiment of FIG. 6 which is arranged between the attachment leg 12 and the clamping leg 14 extends within the clamping frame 3. In contrast to this, the bend 20 of the embodiment of FIG. 11 which is arranged between the base leg 6 and the attachment leg 12 extends within the clamping frame 3, whereas the bend 13 of the embodiment of FIG. 11 which is arranged between the attachment leg 12 and the clamping leg 14 protrudes out of the clamping frame 3.

For this purpose and in analogy to the embodiments of FIGS. 1 and 10, the clamping spring 4 comprises respective protrusions 15, 16 on opposite sides of the attachment leg 12, which protrusions engage in an opening 17 of a longitudinal leg 7, 8 and support the clamping spring 4 on the attachment leg 12.

Two attachment tabs 36 are provided in addition on at least one of the longitudinal legs 7, 8, so that the clamping frame 3 or the connection apparatus 2 can be anchored by means of the attachment tabs 36 on a component such as the insulating material housing 1 (see FIG. 12*a*) or a circuit board.

Figure 12A:
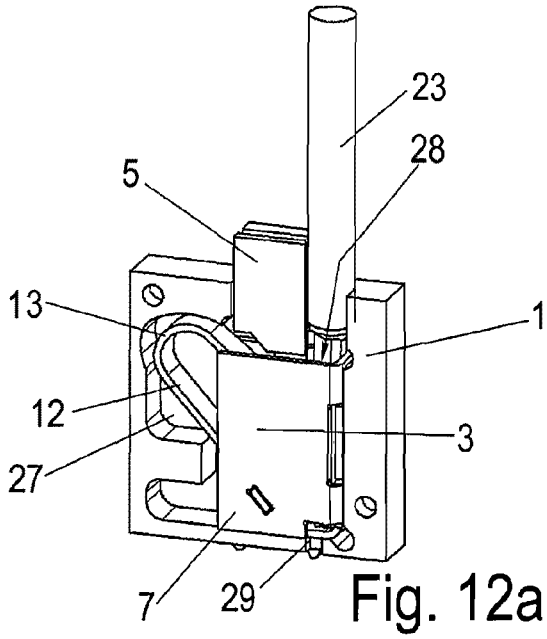
FIGS. 12*a* and 12*b* are, respectively, a perspective view of the connector of FIG. 11 inserted into an insulating material housing, and with the insulating material housing of FIG. 11*b* being arranged as a terminal block housing.
Figure 12B:
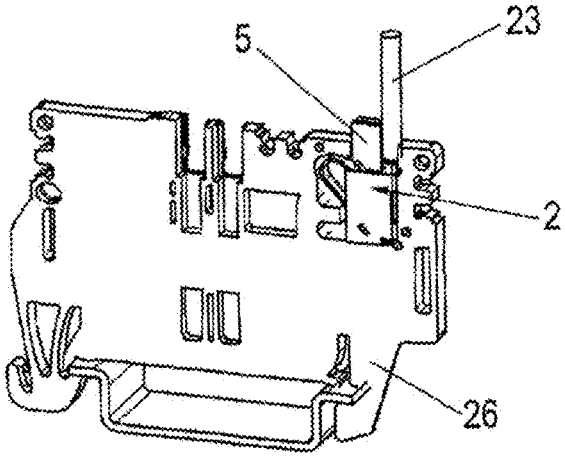

FIGS. 12*a* and 12*b* show the connection apparatus 2 of FIG. 11 respectively in an insulating material housing 1. The chamber removed portion 27 is provided in this case in such a way that it enables the arrangement of the clamping frame 3 and the bend 13 provided between the attachment leg 12 and the clamping leg 14.

FIGS. 12*a* and 12*b* also show the optional actuation button 5, which button is arranged in a laterally offset manner in relation to the insertion opening 28. The insulating material housing 1 further comprises openings 29 for inserting the fastening knobs 36 in order to anchor the clamping frame 3 in the insulating material housing 1.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector adapted for connection with the bare end of a vertically-arranged insulated conductor, comprising:

(a) a U-shaped sheet metal clamping frame (3) including a vertical planar base wall (6), and a pair of vertical parallel spaced planar side walls (7, 8) extending orthogonally from said base wall, said base and side walls cooperating to define a chamber (C) having top (10), bottom (11), and side (9) openings;

(b) contact means defining a stationary electrical contact (6; 19; 32) so arranged relative to said chamber that the conductor may be axially inserted vertically downwardly into said frame chamber via said top opening toward an inserted position adjacent said stationary contact;

(c) clamping spring means (4) arranged at least partially within said chamber for biasing the conductor bare end laterally toward engagement with said electrical contact, said clamping spring means comprising a conductive leaf spring including:

(1) a clamping leg (14); and (2) attachment leg means supporting said clamping leg in said chamber on the opposite side of the conductor insertion axis from said electrical contact, said attachment leg means supporting said clamping leg in a clamping position in which said clamping leg is arranged at a first acute angle (β) relative to said insertion axis, said attachment leg means including:

(1) a resilient integral first bend portion (13) connected at one end with one end of said clamping leg;

(2) an attachment leg (12) having a first end integrally connected with the other end of said first bend portion; and (3) connecting means connecting said attachment leg with said frame at a second acute angle (α) relative to said insertion axis, said connecting means including:

(a) at least one lateral protrusion (15) on said attachment leg; and (b) a corresponding slot (17) contained in the adjacent frame side wall for receiving said attachment leg lateral protrusion, and (d) a housing (1) formed of electrical insulating material, said housing containing a housing chamber (27) in which said clamping frame is mounted, said housing containing a conductor inlet opening (28) communicating with said housing chamber opposite said spring clamping leg.

2. An electrical connector as defined in claim 1, and further including:

(e) a release button (5) arranged in said housing inlet opening for manually displacing said clamping arm in the opposite direction away from said clamping position.

3. An electrical conductor as defined in claim 1, wherein said attachment leg connecting means further includes:

(c) a second bend portion (20) integrally connected at one end with the other end of said attachment leg; and (d) a contact leg (19) integrally connected with the other end of said second bend portion, said contact leg being in parallel contiguous engagement with the inner surface of said frame base wall.

4. An electrical connector as defined in claim 3, wherein said attachment leg connecting means further includes:

(e) at least one lateral contact leg protrusion (21) that extends from said contact leg through a corresponding slot (22) contained in said frame.

5. An electrical connector as defined in claim 3, and further including:

(e) a conductive soldering pin (24) connected with said second bend portion, said soldering pin extending outwardly from said housing chamber via an outlet opening (29) contained in said housing.

6. An electrical connector as defined in claim 1, wherein said frame is formed from a spring steel sheet having a thickness no greater than 0.6 mm.

7. An electrical connector as defined in claim 1, wherein said second acute angle ($\alpha$) between said attachment leg (12) and said insertion axis is between 20° and 70°.

8. An electrical connector as defined in claim 1, wherein said housing comprises a terminal block (26) adapted for mounting on a support rail.

9. An electrical connector adapted for connection with the bare end of a vertically-arranged insulated conductor, comprising:

(a) a U-shaped sheet metal clamping frame (3) formed from a conductive metallic material, said clamping frame including a vertical planar base wall (6), and a pair of vertical parallel spaced planar side walls (7, 8) extending orthogonally from said base wall, said base and side walls cooperating to define a chamber (C) having top (10), bottom (11), and side (9) openings;

(b) contact means defining a stationary electrical contact (6; 19; 32) so arranged relative to said chamber that the conductor may be axially inserted vertically downwardly into said frame chamber via said top opening toward an inserted position adjacent said stationary contact;

(c) clamping spring means (4) arranged at least partially within said chamber for biasing the conductor bare end laterally toward engagement with said electrical contact, said clamping spring means comprising a conductive leaf spring including:

(1) a clamping leg (14); and (2) attachment leg means supporting said clamping leg in said chamber on the opposite side of the conductor insertion axis from said electrical contact, said attachment leg means supporting said clamping leg in a clamping position in which said clamping leg is arranged at a first acute angle ($\beta$) relative to said insertion axis, said attachment leg means including:

(1) a resilient integral first bend portion (13) connected at one end with one end of said clamping leg;

(2) an attachment leg (12) having a first end integrally connected with the other end of said first bend portion; and (3) connecting means connecting said attachment leg with said frame at a second acute angle ($\alpha$) relative to said insertion axis, said attachment leg connecting means including a second bend portion (20) integrally connected at one end with the other end of said attachment leg, the other end of said second bend portion being integrally connected with said frame base wall (6), whereby said frame base wall defines said stationary electrical contact, and (d) a housing (1) formed of electrical insulating material, said housing containing a housing chamber (27) in which said clamping frame is mounted, said housing containing a conductor inlet opening (28) communicating with said housing chamber opposite said spring clamping leg.

10. An electrical connector as defined in claim 9, and further including:

(e) a tulip type contact (30) connected with the lower edge of one of said frame side walls.

11. An electrical connector as defined in claim 9, and further including:

(e) at least one attachment tab (36) extending integrally downwardly from the lower edge portion of at least one of said frame side wall, thereby to define means for attaching said frame to a printed circuit board (25).

12. An electrical connector as defined in claim 11, wherein a plurality of said connectors are mounted in a row on the printed circuit board (25).

13. An electrical connector adapted for connection with the bare end of a vertically-arranged insulated conductor, comprising:

(a) a U-shaped sheet metal clamping frame (3) including a vertical planar base wall (6), and a pair of vertical parallel spaced planar side walls (7, 8) extending orthogonally from said base wall, said base and side walls cooperating to define a chamber (C) having top (10), bottom (11), and side (9) openings;

(b) contact means defining a stationary electrical contact so arranged relative to said chamber that the conductor may be axially inserted vertically downwardly into said frame chamber via said top opening toward an inserted position adjacent said stationary contact, said contact means comprising:

(1) an L-shaped contact rail (R) having a vertical first leg portion (32) arranged in said frame chamber parallel with said frame base wall, and a horizontal contact tongue portion (35) that extends outwardly of said frame via said frame side opening; and (2) connecting means connecting said contact rail with said frame;

(c) clamping spring means (4) arranged at least partially within in said chamber for biasing the conductor bare end laterally toward engagement with said electrical contact, said clamping spring means comprising a conductive leaf spring including:

(1) a clamping leg (14); and (2) attachment supporting said clamping leg in said chamber on the opposite side of the conductor insertion axis from said electrical contact, said attachment means supporting said clamping leg in a given clamping position in which said clamping leg is arranged at a first acute angle (β) relative to said insertion axis; and (d) a housing (1) formed of electrical insulating material, said housing containing a housing chamber (27) in which said clamping frame is mounted, said housing containing a conductor inlet opening (28) communicating with said housing chamber opposite said spring clamping leg.

14. An electrical connector as defined in claim 13, wherein said contact rail connecting means includes at least one lateral protrusion means (33) extending laterally from said contact rail vertical portion into a corresponding slot (34) contained in the adjacent frame side wall.

15. An electrical connector as defined in claim 13, wherein said contact rail vertical portion (32) is parallel with and spaced from said frame base wall; and further wherein said clamping leg attachment means includes a clamping spring first bend portion (13) integrally connected at one end with the upper end of said frame base wall (6), the other end of said first bend first bend portion being integrally connected with said clamping leg, said first bend portion biasing said clamping leg to cause the free end thereof to displace the conductor bare end laterally toward engagement with said contact rail vertical portion.

16. An electrical connector as defined in claim 13, wherein said contact rail first leg portion (32) is in contiguous engagement with the inner surface of said frame base wall.

* * * * *